US009849430B2

(12) United States Patent
Shramo et al.

(10) Patent No.: US 9,849,430 B2
(45) Date of Patent: Dec. 26, 2017

(54) MIXING DEVICE

(71) Applicant: Triad Capital Group, LLC, Columbia Station, OH (US)

(72) Inventors: Daniel John Shramo, Avon, OH (US); James David Galvin, Columbia Station, OH (US)

(73) Assignee: Triad Capital Group, LLC, Columbia Station, OH (US)

( * ) Notice: Subject to any disclaimer, the term of this patent is extended or adjusted under 35 U.S.C. 154(b) by 408 days.

(21) Appl. No.: 14/037,895

(22) Filed: Sep. 26, 2013

(65) Prior Publication Data

US 2014/0086006 A1 Mar. 27, 2014

Related U.S. Application Data

(60) Provisional application No. 61/705,738, filed on Sep. 26, 2012.

(51) Int. Cl.

| | |
|---|---|
| ***B01F 7/16*** | (2006.01) |
| ***B01F 7/00*** | (2006.01) |
| ***B01F 7/22*** | (2006.01) |
| ***B01F 15/00*** | (2006.01) |

(52) U.S. Cl.

CPC ..... *B01F 7/1695* (2013.01); *B01F 7/00641* (2013.01); *B01F 7/22* (2013.01); *B01F 15/00707* (2013.01); *B01F 2215/005* (2013.01)

(58) Field of Classification Search

CPC .. B01F 7/00083; B01F 7/001; B01F 7/00191; B01F 7/0025; B01F 7/00341; B01F 7/00375; B01F 7/22; B01F 7/20; B01F 15/00675; B01F 7/1695; B01F 7/00641; B01F 15/00707

USPC ..... 366/265, 270

See application file for complete search history.

(56) References Cited

U.S. PATENT DOCUMENTS 2,760,762 A * 8/1956 Woodman ..... B01F 7/1695 366/314
3,111,305 A * 11/1963 Bates ..... B01F 7/00141 366/325.92
3,132,850 A 5/1964 Puchalski
(Continued)

FOREIGN PATENT DOCUMENTS

FR EP 2926892 A1 * 10/2015 ..... B01F 7/00375

*Primary Examiner* — Charles Cooley
*Assistant Examiner* — Marc C Howell
(74) *Attorney, Agent, or Firm* — Tucker Ellis LLP; Heather M. Barnes

(57) ABSTRACT

Apparatus and methods for a mixing device are presented. The mixing device comprises a shaft and a plurality of blades attached to the shaft. The blades include a variable pitch angle configured to create axial fluid flow and radial fluid flow within a container. The apparatus includes a hub and a cage located at ends of the apparatus. The cage includes an open end configured to mate with a structure attached to the container. In further examples of the apparatus, the upper blade is configured to create axial flow in a substantially downward direction. The lower blade is configured to create axial flow in a substantially upward direction. The lower blade can create an axial flow that encounters the upper blade. A method includes locating a mixing apparatus within the container, inserting fluid within the container, rotating the mixing apparatus, and mixing the fluid.

25 Claims, 5 Drawing Sheets

(56) References Cited

U.S. PATENT DOCUMENTS

| | | | | | |
|---|---|---|---|---|---|
| 3,608,976 | A * | 9/1971 | Zugelder | F04D 29/289 | 406/97 |
| 4,802,771 | A * | 2/1989 | Weetman | B01F 7/00358 | 366/270 |
| 5,158,434 | A * | 10/1992 | Weetman | B01F 7/00341 | 366/330.5 |
| 5,199,788 | A | 4/1993 | Stallings | | |
| 5,568,975 | A | 10/1996 | Blakley et al. | | |
| 5,762,417 | A * | 6/1998 | Essen | B01F 7/00375 | 366/264 |
| 5,813,837 | A * | 9/1998 | Yamamoto | B01F 7/00341 | 366/270 |
| 7,318,668 | B2 | 1/2008 | Bielozer | | |
| 2002/0172092 | A1* | 11/2002 | Reeder | B01F 7/1655 | 366/270 |
| 2004/0228209 | A1* | 11/2004 | Bielozer | B01F 7/1695 | 366/325.1 |
| 2006/0193201 | A1 | 8/2006 | Schnipke et al. | | |
| 2011/0136721 | A1* | 6/2011 | Erbezci | C11D 3/0089 | 510/513 |
| 2011/0188928 | A1 | 8/2011 | West et al. | | |
| 2016/0177968 | A1* | 6/2016 | Gebert | F04D 29/384 | 416/236 R |

* cited by examiner

MIXING DEVICE

CROSS-REFERENCE TO RELATED APPLICATIONS

This application claims the benefit of U.S. Provisional Application No. 61/705,738, filed Sep. 26, 2012, the entire disclosure of which is hereby incorporated herein by reference.

BACKGROUND OF THE DISCLOSURE

Field of the Disclosure

The present disclosure relates to a device for mixing a fluid medium. The present disclosure further relates to an apparatus for mixing a fluid medium provided in a container. The present disclosure further relates to a method for mixing a fluid medium.

Discussion of Prior Art

Use of fluid agitation devices within a container is known. Such devices can be used, for example, to agitate paint within a drum in order to at least partially mix pigments in the form of solids with the liquid portion of the paint. However, these devices are not known for effective distribution of the pigment solids within the container. Furthermore, many of them lack the ability to create a homogeneous colloid of the pigment solids suspended within the liquid portion of the paint in various volumes of the container. Additionally, many known devices do not create flow zones within the container designed to create a homogeneous colloid throughout the container while promoting a substantially equal paint temperature throughout the container.

Additionally, known paint mixing devices are not known for pumping the fluid and or the colloid throughout the container, but merely agitating the fluid, acting as mechanized stirring sticks. Known mixing devices often merely create eddy currents which are ineffective in creating a homogeneous solution. These eddy currents represent wasted energy that is input into the mixing device, generating little meaningful mixing. Meanwhile, known devices are also relatively expensive to manufacture and require more energy to operate than is necessary. Thus, there is a need for both improvements to liquid mixing devices and developments to increase the effectiveness of liquid mixing devices in containers.

BRIEF DESCRIPTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

In one embodiment, this disclosure features an apparatus for mixing a fluid within a container. The apparatus includes a shaft and a blade attached to the shaft. The blade includes a variable pitch angle, the variable pitch angle is configured to create axial fluid flow and radial fluid flow within the container. The variable pitch angle is between about 55 to about 65 degrees proximate to the shaft, between about 35 to about 45 degrees at a location between the shaft and an end of the blade, and between about 15 to about 25 degrees near the end of the blade. The apparatus also includes a hub located at a proximal end of the shaft.

In another embodiment, an apparatus for mixing a fluid within a container includes a shaft and an upper blade attached to the shaft. The apparatus also includes a lower blade attached to the shaft. The upper blade and the lower blade are attached to the shaft at two different elevations on the shaft. The upper blade and the lower blade each include a variable pitch angle configured to create axial fluid flow and radial fluid flow within the container. The variable pitch angle of the upper blade is configured to create axial flow in a substantially downward direction. The variable pitch angle of the lower blade is configured to create axial flow in a substantially upward direction such that the axial flow from the lower blade continues to an elevation within the container that is above the upper blade. The apparatus also includes a hub located at a proximal end of the apparatus.

In another embodiment, a method of mixing a fluid within a container includes the step of providing a container. The method also includes the step of locating a mixing apparatus within the container. The mixing apparatus includes a shaft, an upper blade attached to the shaft, and a lower blade attached to the shaft. The upper blade and the lower blade are attached to the shaft at two different elevations on the shaft. The upper blade and the lower blade each include a variable pitch angle configured to create axial fluid flow and radial fluid flow within the container. The variable pitch angle of the upper blade is configured to create axial flow in a substantially downward direction. The variable pitch angle of the lower blade is configured to create axial flow in a substantially upward direction such that the axial flow from the lower blade continues to an elevation within the container that is above the upper blade. The mixing apparatus also includes a hub located at a proximal end of the apparatus. The method further includes the step of rotating the mixing apparatus within the container. Rotating the mixing apparatus creates an axial flow vector and a radial flow vector combining to create a complex flow. The method still further includes the step of mixing a quantity of the fluid within the container.

BRIEF DESCRIPTION OF THE DRAWINGS

The foregoing and other aspects of the apparatus and methods will become apparent to those skilled in the art to which the apparatus and methods relate upon reading the following description with reference to the accompanying drawings, in which.

DETAILED DESCRIPTION

Figure 2:
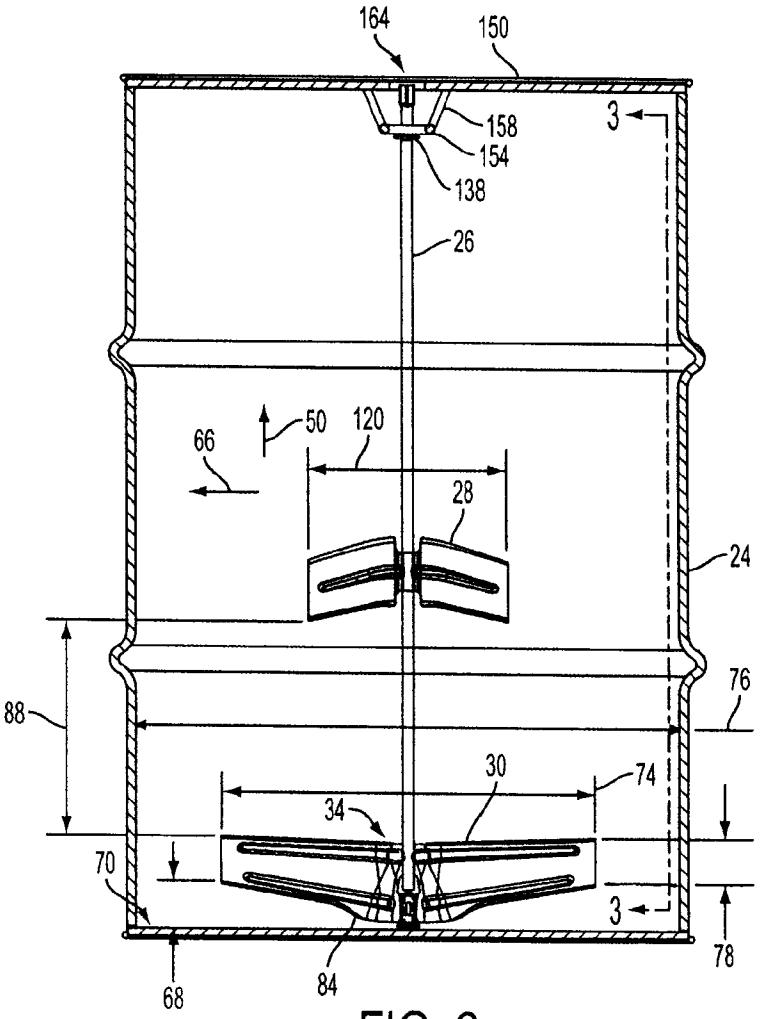
FIG. 2 is an elevation cross section front view of the mixing apparatus of FIG. 1.

Example embodiments that incorporate one or more aspects are described and illustrated in the drawings. These illustrated examples are not intended to be limiting. For example, one or more aspects of the apparatus and methods can be utilized in other embodiments and even other types of devices. Moreover, certain terminology is used herein for convenience only and is not to be taken as a limitation.

Figure 1:
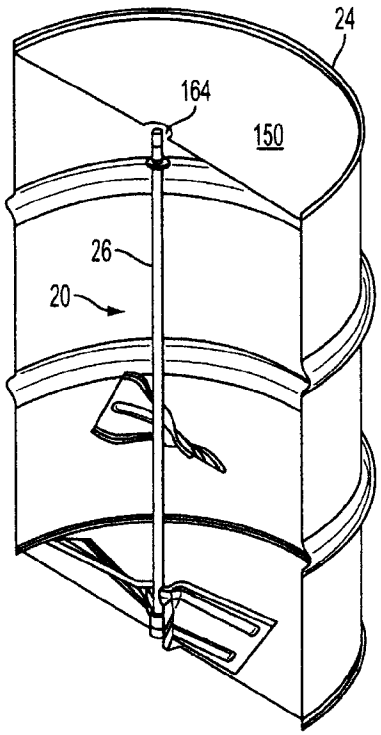
FIG. 1 shows a perspective cut-away view of an example mixing apparatus placed within a container.

An example embodiment of a mixing device 20, which is one example of an apparatus for mixing a fluid is shown in FIG. 1. The mixing device 20 is shown in one example arrangement within a container 24. It is to be appreciated that FIG. 1 merely shows one example of possible structures/configurations/etc. and that other examples are contemplated within the scope of the present disclosure. FIG. 1 is a three-dimensional cut-away view of the mixing device 20 located within the container 24. In one example, the container 24 can be substantially similar to a standard 55-gallon drum. In another example, the container can be a standard 55-gallon drum.

It should be noted that although the mixing device 20 and associated methods are described with respect to the example arrangement including a mixing device of a particular size used within a 55-gallon drum, one of ordinary skill in the art should understand that the presently described apparatus is not limited to such a use. Rather, the presently described apparatus may be used with any type of container in which fluids are to be mixed, including containers of various sizes, shapes, and numerous fluids stored within those containers, etc. Some specific examples include, but are not limited to drums of 105-gallon, 30-gallon, and 15-gallon capacity as well as containers known as "buckets." Other examples can include bulk containers storing fluids in metal, plastic, cardboard, or any combination of these materials. Some of these containers are known as "intermediate bulk containers" or IBC, bins, totes, etc. In other examples, the container 24 can be portable with the mixing device placed within the container 24 prior to placing a quantity of fluid within the container 24. The portable container can then be transported to various locations where the quantity of fluid is desired and the mixing device 20 used prior to application of the fluid.

Figure 3:
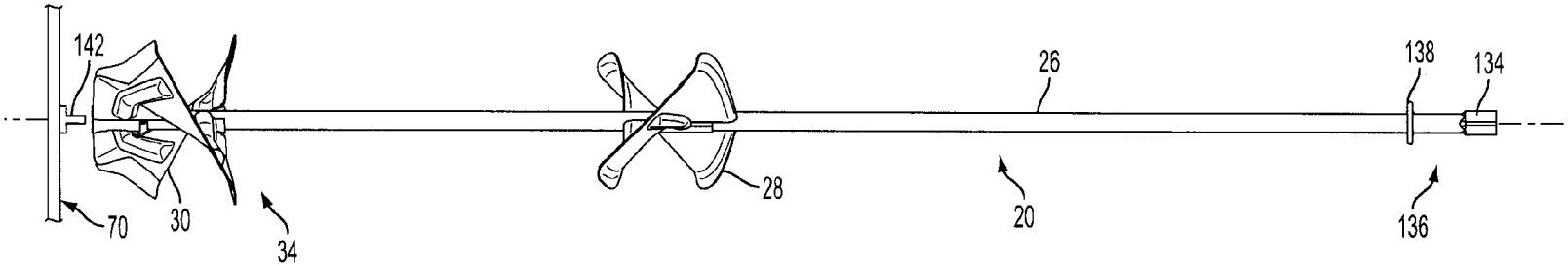
FIG. 3 is a side view of the mixing apparatus taken along line 3-3 of FIG. 2.

Turning to FIG. 2, the mixing device 20 includes a shaft 26. The mixing device 20 is configured to rotate within the container 24, and the shaft 26 provides a central rotation axis. In one example, the shaft 26 has a circular cross-section. In a more particular example, the shaft 26 is constructed of steel wire that is about 7/16-in diameter. It is to be appreciated that shafts of other cross-sections and diameters can be used. Manufacturing costs for the mixing device 20 can be reduced by using steel wire that is unwound from a coiled source of wire, straightened, and then undergo any necessary preparations for use as the shaft 26 of the mixing device 20. In one example, the shaft 26 can have an ultimate tensile strength of about 60,000 psi or greater. A side view of the mixing device 20 is shown in FIG. 3.

Figure 4:
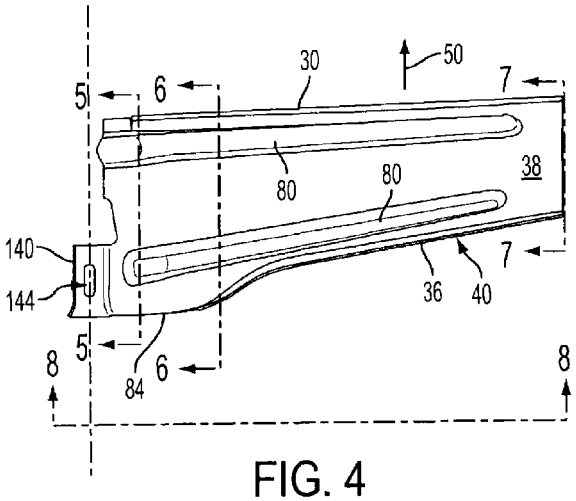
FIG. 4 is an elevation front view of an example lower blade from the mixing apparatus of FIG. 1.

Returning to FIG. 2, a plurality of blades are attached to the shaft. In the shown example, there is an upper blade 28 and a lower blade 30 attached to the shaft 26 at two different elevations. The lower blade 30 can be attached to the shaft 26 at a distal end 34 of the shaft 26. For the purposes of this disclosure, the distal end 34 of the shaft 26 is the end of the shaft 26 that is inserted into a container towards what would typically be a "closed end" or the "bottom end." As shown in FIG. 4, the lower blade 30 can include a separate half of the lower blade 30. Each half can be identical or substantially identical to a corresponding half that, when the two halves are placed diametrically opposite from each other on the shaft, to form a complete lower blade 30. Alternatively, the lower blade 30 can be constructed of one unitary component. No matter the number of pieces making up the lower blade 30, the lower blade 30 can be produced by a stamping from a sheet material, for example, sheet steel. In a more particular example, the lower blade 30 can be stamped from 20-gauge sheet steel having an ultimate tensile strength of about 60,000 psi or greater.

Of course, a 20-gauge sheet steel having an ultimate tensile strength of about 60,000 psi or greater is merely one example of sheet material that can be used. 20-gauge sheet steel can provide a lower blade and an upper blade that are relatively strong while being relatively thin. Various structures, bends, ridges, etc. can be added to the 20-gauge sheet steel to provide structural strength suitable for particular mixing operations without adding material thickness to the lower blade. The 20-gauge sheet steel having an ultimate tensile strength of about 60,000 psi or greater has been demonstrated to withstand the stresses and strains of mixing particular fluids. In one example, the fluids can be paints which can have a relatively wide range of fluid properties such as viscosity and density. The 20-gauge sheet steel having an ultimate tensile strength of about 60,000 psi was chosen as a material that can withstand the demands of mixing a relatively high viscosity and relatively high density paint mixture requiring a 700-800 lb-in torque value to effectively mix the paint. Of course, if a specific fluid to be mixed has a relatively low viscosity and relatively low density, the 20-gauge sheet steel can be replaced by a thinner gauge sheet steel and the sheet steel can have a lower ultimate tensile strength in order to reduce the cost and manufacturing demands of the mixing device 20. Likewise, mixing applications requiring higher torque values can also necessitate a thicker gauge sheet steel and a higher value ultimate tensile strength. While the remainder of the disclosure refers to the fluid primarily in terms of paint, it is to be appreciated that the fluid can be paint, chemicals, or any other fluid or colloid, etc. that may benefit from being mixed into a homogeneous condition to have a continuous chemistry (e.g., a consistent throughout the fluid) and/or a temperature that is consistent or is substantially consistent throughout the fluid. In one example, the temperature of the fluid can be measured at various locations within the container to establish a homogeneous or consistent temperature. The fluid can also comprise a quantity of solid particles which flow as a fluid.

Figure 5:
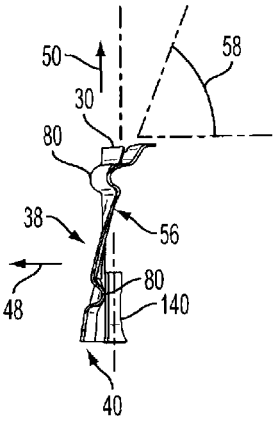
FIG. 5 is a section view of the lower blade taken along line 5-5 of FIG. 4.
Figure 6:
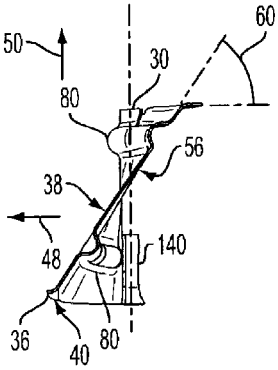
FIG. 6 is a section view of the lower blade taken along line 6-6 of FIG. 4.
Figure 7:
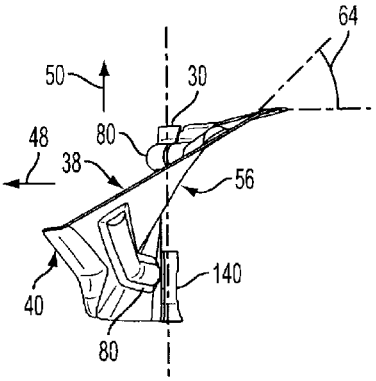
FIG. 7 is a section view of the lower blade taken along line 7-7 of FIG. 4.

In one example, the lower blade 30 includes at least one ridge 36 configured to impart strength to the lower blade 30. In a more particular example, the at least one ridge 36 is located on a leading side 38 of the lower blade 30. As can be seen in FIGS. 5-7, an example ridge 36 can be located at the bottom edge 40 of the lower blade 30. It is to be appreciated that the size and shape of the ridge 36 can be selected to both strengthen the lower blade 30 and form a hydrofoil. The hydrofoil can be shaped to move smoothly through the fluid causing the fluid to be deflected in an axial direction as represented by arrow 50. This deflection of the fluid causes higher pressure on the leading side 38 of the lower blade 30 and reduced pressure on a trailing side 56 of the lower blade 30. This pressure difference is accompanied by a velocity difference, via Bernoulli's principle, so the resulting fluid flow about the hydrofoil has a higher average velocity on one side than the other.

In one example, the halves and/or the one unitary component of the lower blade 30 are rigidly attached to the shaft 26 at a location as shown in FIG. 2. The lower blade 30 can be welded to the shaft 26. In one example, the weld connection(s) between the lower blade 30 and the shaft 26 is configured to withstand 60,000 psi ultimate tensile strength such that the weld(s) has an ultimate tensile strength at least substantially equal to the ultimate tensile strength of the shaft 26. In the case of half-sections being welded to the shaft 26 to form a single lower blade 30, two half-sections are located 180 degrees from one another so that one half-section lies substantially within the same plane as its corresponding half-section. In other words, the two half-sections form a straight line, similar to a diameter across the container 24. In other examples, more than one lower blade 30 can be attached to the shaft 26.

Turning to FIGS. 5-7, the lower blade 30 can include several structural elements configured to aid the mixing and/or pumping of the fluid within the container 24. In one example, the lower blade 30 includes a variable pitch angle 58, 60, 64. The pitch angle can also be referred to as an angle of attack. The variable pitch angle 58, 60, 64 can be measured as the angle created between the surface of the leading side 38 of the lower blade 30 and a horizontal line in the direction of arrow 48 as shown in FIGS. 5-7. This variable pitch angle 58, 60, 64 is configured to create axial fluid flow and radial fluid flow within the container 24, which can be termed a "mixed flow." FIGS. 5-7 illustrate how the pitch angle 58, 60, 64 is varied from the area of the lower blade 30 proximate the shaft 26 (pitch angle 58), an area closer to the middle of the lower blade 30 (pitch angle 60), and at the end of the lower blade 30 (pitch angle 64). In one example, the variable pitch angle 58, 60, 64 varies between about 60 degrees to about 20 degrees. This variation in pitch angle tends to optimize the axial component of the fluid flow such that the fluid flow leaving the lower blade 30 along substantially the entire length of the lower blade 30 is imparted with equal or substantially equal magnitude axial components in the fluid flow. It is to be appreciated that the magnitude of the axial component of the fluid flow proximate to the shaft 26 may be less than along the rest of the lower blade 30 because of This variation also tends to push the fluid (e.g., paint) in an axial direction 50 to create axial fluid flow and in a radial direction as represented by arrow 66 (best seen in FIG. 2) to create radial fluid flow.

In one example, the variable pitch angle 58 is between about 55 to about 65 degrees proximate to the shaft 26, the variable pitch angle 60 is between about 35 to about 45 degrees at a location between the shaft 26 and an end of the lower blade 30, and the variable pitch angle 64 is between about 15 to about 25 degrees near the end of the lower blade 30. More particularly, the variable pitch angle 58 is about 60 degrees proximate to the shaft 26, the variable pitch angle 60 is about 40 degrees at a location between the shaft 26 and an end of the lower blade 30, and the variable pitch angle 64 is about 20 degrees near the end of the lower blade 30.

Returning to FIG. 2, another structural aspect of the lower blade 30 that assists in the mixing of a fluid (e.g., paint) includes a substantial length of the lower blade 30 located a distance 68 above a floor 70 of the container 24. In one example, the distance 68 is between about one-inch and about three-inches, and more particularly, the distance 68 is between about 1½-inches and 2½-inches.

Similarly, a length 74 of the lower blade 30 is between about 40% and about 70% of an inside dimension 76 (e.g., an inside diameter) of the container 24. In a more particular example, the length 74 of the lower blade 30 is between about 50% and about 60% of the inside dimension 76 of the container 24. In the particular example of the container 24 being a 55-gallon drum, the inside dimension 76 can be about 22½ inches, and the vertical inside dimension can be about 33½ inches. There are appreciable benefits to locating a substantial length of the lower blade 30 above the floor 70 of the container 24 and having the lower blade 30 positioned a particular distance from the inside dimension 76 of the container 24. In both cases, these spaces permit flows of fluid (e.g., paint) to be drawn from adjacent areas, propelled by the lower blade 30, and then creating a flow zone, or circulation pattern in which the fluid can return to the spaces and interact with the lower blade 30 repeatedly. It is to be appreciated that some mixing device designs which may be known position mixing blades in locations adjacent to or in contact with container walls. This positioning is known to deter fluid flow during a mixing operation. As such the present disclosure describes a fluid pumping device rather than a device that creates mere agitation or simple stirring of a fluid.

In one example, a width 78 of the lower blade 30 is between about 20% and about 30% of the length 74 of the lower blade 30. This ratio of the width 78 to the length 74 of the lower blade 30 can be beneficial in at least three ways. First, the described ratio sets a range that limits the material cost. Second, the described ratio also helps limit the power required to drive (e.g., rotate) the mixing device 20 within a fluid. Third, calculations and experimental results have shown a lack of beneficial mixing work in ratios higher than that described above. Thus, as a blade is widened with respect to the length of the blade in ratios greater than the described ratio, the additional energy required to rotate the mixing device supplies little to no appreciable additional mixing work.

Returning to FIGS. 4-7, the lower blade 30 can include at least one stiffening rib 80. Formation of the stiffening rib 80 can be included in the stamping operation and be an integral portion of the lower blade 30. Alternatively, the stiffening rib 80 can be added after the stamping operation. The stiffening rib 80 is configured to stiffen or add strength to the lower blade 30. Furthermore, the stiffening rib 80 can help ensure smooth flow of the fluid along the lower blade 30. The stiffening rib 80 can be generally oriented along the length 74 of the lower blade 30. In the shown example, the lower blade 30 includes one stiffening rib 80 that is convex in relationship to the leading side 38 of the lower blade 30 and another stiffening rib 80 that is concave in relationship to the leading side 38 of the lower blade 30. It is to be appreciated that any combination of multiple styles of stiffening ribs 80 can be included on the lower blade 30. FIGS. 4 and 5 show at least one stiffening rib 80 extending to the shaft 26. In one example, the stiffening rib 80 takes mechanical load from the lower blade 30 length to the shaft 26.

Another structural aspect of the lower blade 30 that assists in the mixing of a fluid includes the lower blade 30 further including a secondary pumping blade 84. The secondary pumping blade 84 is located approximately centrally about the shaft 26 and is configured to help prevent a stagnant volume of fluid at the center of the container 24 near the floor 70 of the container 24. As can be appreciated, the linear speed of the mixing device 20 is proportional to its distance from its center of rotation, for example, the shaft 26. In order to help encourage movement of fluids, particulate matter, pigment solids, etc. at the floor 70 of the container 24 located close to the shaft 26, the secondary pumping blade 84 passes within closer proximity to the floor 70 than the remainder of the lower blade 30.

Figure 8:
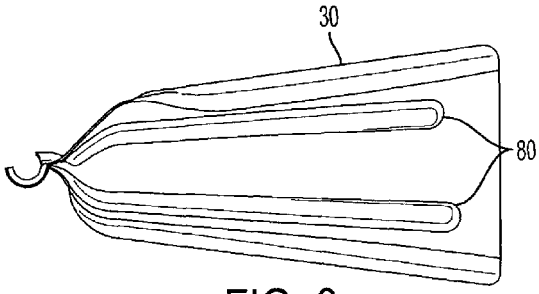
FIG. 8 is a top view of the lower blade.

FIG. 8 shows a bottom view of one half of the lower blade 30.

Figure 9:
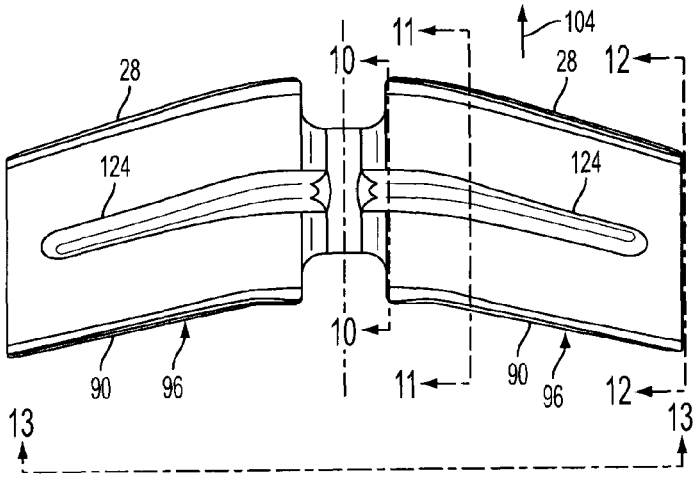
FIG. 9 is an elevation front view of an example upper blade from the mixing apparatus of FIG. 1.

As described previously, the mixing device 20 further includes the upper blade 28 as shown in FIG. 2. The upper blade 28 is located above the lower blade 30 at a distance 88. In one example, distance 88 is from about 75% to about 120% of the inside dimension 76 of the container 24. As shown in FIG. 9, the upper blade 28 can be composed of one unitary component, although, like the lower blade 30, the upper blade 28 can conceivably be composed of segments assembled to construct a single upper blade 28. No matter the number of pieces making up the upper blade 28, the upper blade 28 can produced by a stamping from a sheet material, for example, sheet steel. In a more particular example, the upper blade 28 can be stamped from 20-gauge sheet steel having an ultimate tensile strength of about 60,000 psi or greater.

Similar to the lower blade 30, one example of the upper blade 28 includes at least one ridge 90 configured to impart strength to the upper blade 28. In a more particular example, the at least one ridge 90 is located on a leading side 92 of the upper blade 28. In addition to imparting strength to the upper blade 28, the ridge 90 forms the leading edge of a hydrofoil. As can be seen in FIG. 9, an example ridge 90 can be located at the bottom edge 96 of the upper blade 28. It is to be appreciated that the size and shape of the ridge 90 can be selected to both strengthen the upper blade 28 and form a desired hydrofoil shape. The hydrofoil can be shaped to move smoothly through the fluid causing the fluid to be deflected in an axial direction as represented by arrow 104. This deflection of the fluid causes higher pressure on a leading side 92 of the upper blade and reduced pressure on a second side 108 of the upper blade 28. This pressure difference is accompanied by a velocity difference, via Bernoulli's principle, so the resulting fluid flow about the hydrofoil has a higher average velocity on one side than the other.

In one example, the upper blade 28 can be attached to the shaft 26 by a welding operation to place the upper blade 28 at the location shown in FIG. 2. In one example, the weld connection between the upper blade 28 and the shaft 26 is configured to withstand 60,000 psi ultimate tensile strength such that the weld has an ultimate tensile strength at least substantially equal to the ultimate tensile strength of the shaft 26. In the case of two halves being welded to the shaft 26 to form a single upper blade 28, two half-sections are located 180 degrees from one another so that one half-section lies substantially within the same plane as its corresponding half-section. In other words, the two half-sections form a straight line, similar to a diameter across the container 24. In other examples, more than one upper blade 28 can be attached to the shaft 26.

Figure 10:
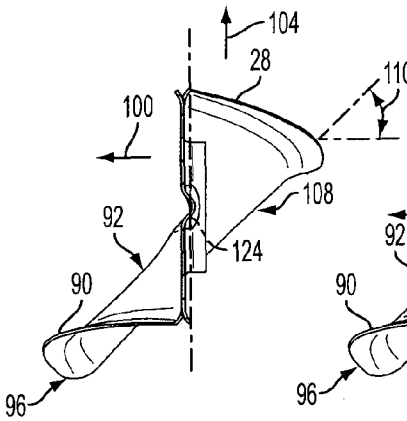
FIG. 10 is a section view of the upper blade taken along line 10-10 of FIG. 9.
Figure 11:
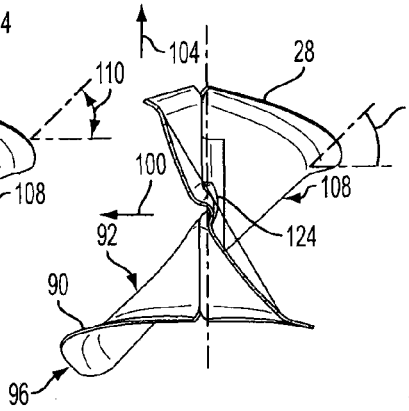
FIG. 11 is a section view of the upper blade taken along line 11-11 of FIG. 9.
Figure 12:
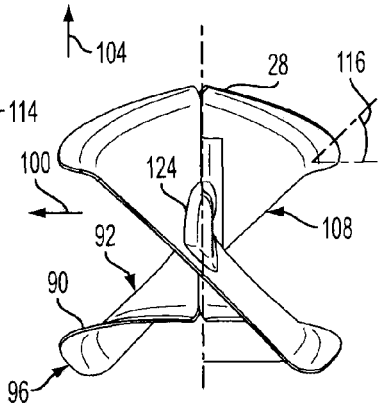
FIG. 12 is a section view of the upper blade taken along line 12-12 of FIG. 9.

Turning to FIG. 10-12, the upper blade 28 can include several structural elements designed to aid the mixing of a fluid within the container 24. In one example, the upper blade 28 includes a variable pitch angle 110, 114, 116. The variable pitch angle 110, 114, 116 can be measured as the angle created between the surface of the leading side 92 of the upper blade 28 and a horizontal line in the direction of arrow 100 as shown in FIGS. 10-12. This variable pitch angle 110, 114, 116 is configured to create axial fluid flow and radial fluid flow within the container 24. FIGS. 10-12 illustrate how the variable pitch angle 110, 114, 116 is varied from the area of the upper blade 28 proximate the shaft 26 (pitch angle 110), an area closer to the middle of the upper blade 28 (pitch angle 114), and at the end of the upper blade 28 (pitch angle 116). In one example, the variable pitch angle 110, 114, 116 varies between about 60 degrees to about 20 degrees. This variation tends to push the fluid (e.g., paint) in an axial direction 104 to create axial fluid flow and in a radial direction 66 (best seen in FIG. 2) to create radial fluid flow. The change in the variable pitch angle 110, 114, 116 can be the same as the change in variable pitch angle 58, 60, 64 as previously described for the lower blade 30. It is to be appreciated that the length of the upper blade 28 can be less than the length of the lower blade 30, and, as such, the range of the variable pitch angle 110, 114, 116 can be less than the range for the variable pitch angle 58, 60, 64.

Returning to FIG. 2, another structural aspect of the upper blade 28 that assists in the mixing of a fluid (e.g., paint) includes an overall upper blade length 120 of about 0.4 times the inside dimension 76 of the container 24. In the particular example of a 55-gallon drum, the upper blade length 120 is less than about nine inches. The gap between the inside surface of the 55-gallon drum and the upper blade 28 enables fluid flow in a generally upward direction from the lower blade 30 to pass by the upper blade 28, gradually turn downward and encounter the upper blade 28 to be circulated down the central portion of the 55-gallon drum due to axial flow forces created by the upper blade 28. Some known mixing tools prevented this flow between a blade and the drum inside diameter, thereby compartmentalizing flow and preventing complex flow throughout the container.

Returning to FIGS. 9-12, the upper blade 28 can include at least one stiffening rib 124. Formation of the stiffening rib 124 can be included in the stamping operation and be an integral portion of the upper blade 28. Alternatively, the stiffening rib 124 can be added after the stamping operation. The stiffening rib 124 is configured to stiffen or add strength to the upper blade 28. Furthermore, the stiffening rib 124 can help ensure smooth flow of the fluid along the upper blade 28. The stiffening rib 124 can be generally oriented along the upper blade length 120. In the shown example, the upper blade 28 includes one stiffening rib 124 that is convex in relationship to the leading surface of the upper blade 28. It is to be appreciated that any combination of multiple styles of stiffening ribs 124 can be included on the upper blade 28.

Figure 13:
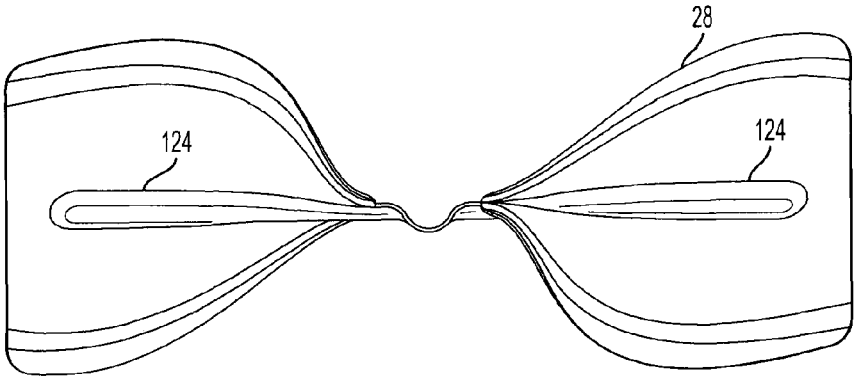
FIG. 13 is a top view of the upper blade.

FIG. 13 shows a bottom view of the upper blade 28.

Returning to FIG. 3, the mixing device 20 includes a hub 134 located at a proximal end 136 of the mixing device 20, which can be at the proximal end of the shaft 26. The hub 134 can be a drive fitting configured to interact with a drive member (not shown) of a rotating device, for example a conventional air motor. In one example, the hub 134 is a male, square drive fitting configured to be inserted into a square, female drive component of an air motor. In another example, one end of the hub 134 includes a rounded shape or a chamfered edge to help facilitate the mating of the male square drive fitting of the hub 134 into a square, female drive component of an air motor. Although a square drive component is described, it is to be appreciated that the hub 134 can be of any suitable configuration. In the shown example, the male, square drive fitting is a forged end of the shaft 26, however, the drive fitting can be a separate member attached to the shaft 26 by any suitable method as is known in the art. In another example, the hub 134 can be warm-headed at about 800° F. to be formed from the shaft 26.

The mixing device 20 can also include a keeper 138 located near the proximal end 136 of the mixing device 20. As in the shown example, the keeper 138 can be a substantially cylindrical member attached to the shaft 26 and can be configured to interact with a component of a lid 150 fastened to the container 24. The keeper 138 and the component interact to provide a physical interference that prevents the mixing device 20 from sliding axially out of the container 24. In one example, the keeper 138 is an integral part of the steel wire shaft 26 that is forged into a selected shape. In another example, the keeper 138 can be formed of other materials in other shapes, and be attached to the shaft 26 by any suitable means. As can be appreciated, the location of the keeper 138 may require a position that accounts for deflection of the floor 70 of the container 24 during times when the container 24 is at least partially filled with fluid and the container 24 is positioned generally upright.

Returning to FIGS. 4-8, the mixing device 20 includes a cage 140 located at the distal end 34 of the mixing device 20. The cage 140 comprises an open end configured to mate with a structure 142 (best seen in FIG. 3) attached to the container 24. FIG. 3 shows the mixing device 20 separated from the structure 142 for purposes of clarity. Often times, the structure attached to the container 24 is a pin-like structure 142 that extends substantially perpendicularly away from the floor 70 of the container 24. As the mixing device 20 is placed into the container 24, the cage 140 slides over the structure 142 attached to the container 24. Interaction between the pin-like structure 142 and the cage 140 helps limit and/or prevent motion of the mixing device 20 in a direction that is generally perpendicular to the shaft 26. The interaction also helps center the mixing device 20 within the container 24. As the mixing device 20 is rotated by the air motor, interaction between the cage 140 and the pin-like structure 142 enables the mixing device 20 to rotate about the pin-like structure 142. In one example, the cage 140 can be a generally cylindrical member attached to the shaft 26 by any suitable method. In another example, the cage 140 can be an integral part of the shaft 26 which is forged into the end of the shaft 26. In yet another example, such as the examples shown in FIGS. 4-8, the cage 140 can be a component separate from the shaft 26 that is attached to the lower blade 30 or unitary to the lower blade 30. In one example, the cage 140 is welded to the lower blade 30. In another example, a portion of the cage 140 (e.g. approximately half) is formed by the stamping operation for one half of the lower blade 30. The cage 140 can include windows 144 that can enable a coating operation described below to coat the interior of the cage 140. It is to be appreciated that some examples of the mixing device 20 do not include the cage 140.

The mixing device 20 can further include a powder coat over a substantial portion of the surfaces of the shaft 26, the blades 30, 28, the hub 134, and the cage 140. In one example, the powder coat can be a type of airborne electrostatic application forming a durable coating over the exterior surfaces of the mixing device 20. There are several appreciable benefits to including a powder coat to the mixing device including, but not limited to, rust preventative, increased wear resistance, scratch resistance, impact resistance, and general all-around protection versus an unprotected steel surface of the mixing device 20. In other examples, the mixing device 20 can be coated using other coating processes such as "A-coat," "E-coat," and any other coating processes as are known in the art. In another example, the mixing device 20 may not have a coating applied to its exterior surface.

The mixing device 20 can be configured to withstand about 700 to 800 lb-in of torque or greater applied to the shaft 26. In one example, the selection of steel having a relatively high ultimate tensile strength and the creation of welds having a similar ultimate tensile strength as the mixing device steel components enables the mixing device 20 to withstand about 700 to 800 lb-in of torque or greater to accommodate mixing of relatively high density, high viscosity fluids. Torque requirements for mixing fluids having average density and viscosity can be substantially lower. In one example, the ability to withstand about 700 to 800 lb-in of torque or greater applied to the shaft 26 indicates the mixing device 20 will not physically separate or crack due to the forces applied to it during normal operation with the specified torque loading. The ability to withstand about 700 to 800 lb-in of torque or greater applied to the shaft 26 can also include only elastic deformation of the mixing device 20 during normal operation. Of course, these limitations may be limited to a reasonably expected lifetime of the mixing device 20. In another example, the mixing device 20 is configured to withstand the maximum amount of torque delivered to the mixing device by a standard air motor which is commonly used to mix/stir/agitate fluids within containers. It is to be appreciated that the individual components of the mixing device 20 can also be configured/designed similarly. For example, the upper blade 28 and the lower blade 30 can be configured to withstand about 700 to 800 lb-in of torque or greater applied to the shaft 26. As noted previously, the 700 to 800 lb-in of torque is but one design criteria. As the physical characteristics of the fluid to be mixed change, the design criteria can change to accommodate the differing fluid physical characteristics. For example, if a fluid to be mixed has a relatively low viscosity and a relatively low density, the corresponding torque design criteria can be lowered. The 700 to 800 lb-in of torque criteria is used as it is believed to be adequate or more than adequate to mix fluids with the relatively high viscosity and relatively high density values.

Figure 14:
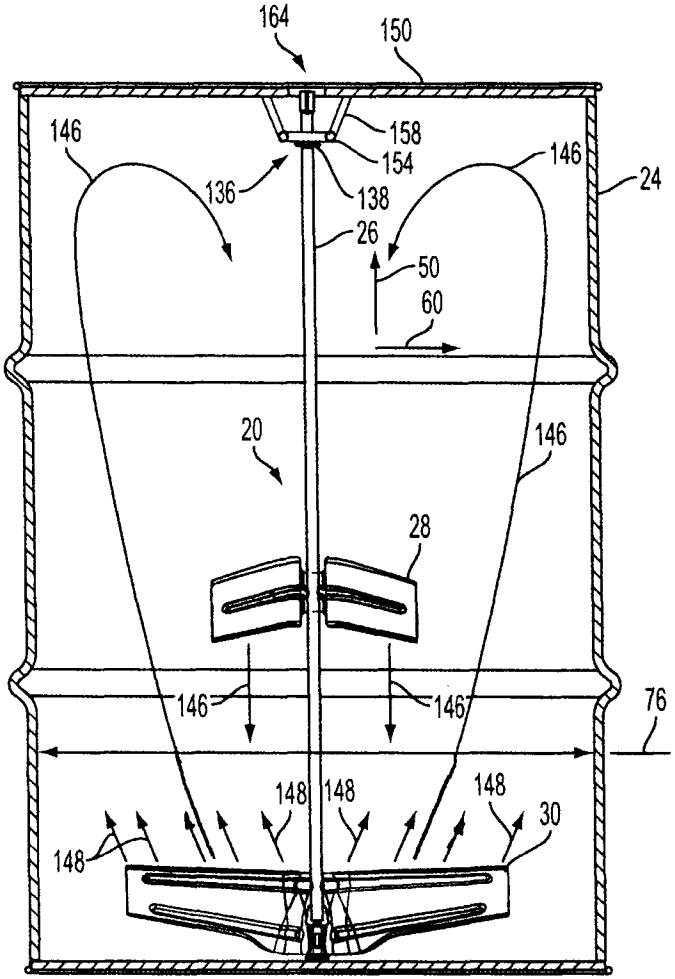
FIG. 14 is an elevation cross section front view of the mixing apparatus within the container showing a complex flow.

Turning to FIG. 14, it is to be appreciated that with respect to the lower blade 30, the axial fluid flow has an axial vector component (direction represented by arrow 50) and the radial fluid flow has a radial vector component (direction represented by arrow 66), the axial vector component and the radial vector component can combine during a mixing operation to create a complex motion of the fluid in three dimensions. Arrows 146 represent the complex motion of the fluid developed by at least one embodiment of the mixing device 20. It is to be understood that the arrows 146 are only representative and other, similar flow paths can exist within the container 24 pumping fluid throughout the container 24. Similarly, with respect to the upper blade 28, the axial fluid flow has an axial vector component and the radial fluid flow has a radial vector component, the axial vector component and the radial vector component can combine during a mixing operation to create a complex motion of the fluid in three dimensions. Furthermore, the axial and radial fluid flows from the lower blade 30 can combine with the axial and radial fluid flows from the upper blade 28 to create a complex motion of the fluid in three dimensions. In one example, the upper blade 28 can create mostly axial fluid flow and minimal radial flow.

Figure 15:
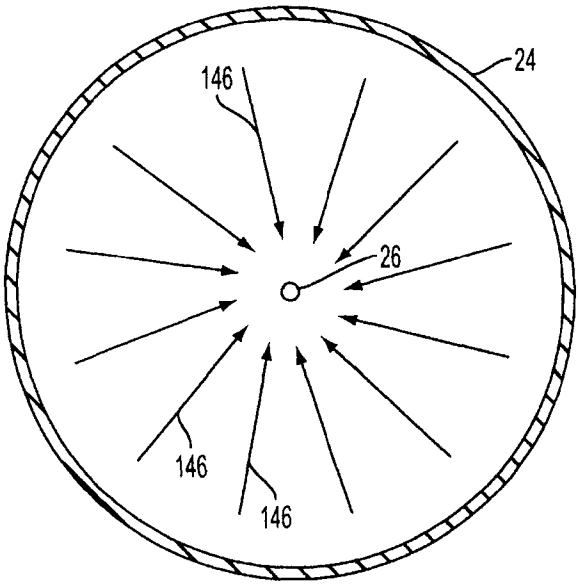
FIG. 15 is a cross section top view of the mixing apparatus showing a complex flow.

In one particular example, the length of an axial flow path developed by the lower blade 30 is between about 0.8 and about 1.2 times the length 76 of the inside dimension (e.g., inside diameter) of the container 24. As such, the axial flow developed by the lower blade 30 can pass by the upper blade 28 in the annular space between the upper blade 28 and the inside surface of the container 24. After passing the upper blade 28, the axial flow from the lower blade 30 can turn downward and encounter the upper blade 28. As such, at the upper limit of the axial flow path, the fluid can turn toward a radial direction, thereby marking the end of the axial flow path in the axial direction 50. The radial flow caused by the lower blade 30 creates fluid movement from the shaft 26 to the outside edge of the lower blade 30 and beyond. In one example, the length of an axial flow path from the upper blade 28 extends to the lower blade 30 so that the fluid flow from the upper blade 28 interacts with the lower blade 30. In another example, the variable pitch angle 58, 60, 64 of the lower blade 30 is configured to develop a uniform magnitude of axial flow as represented by arrows 148. As described previously, the variation in pitch angle tends to optimize the axial component of the fluid flow such that the fluid flow leaving the lower blade 30 along the entire length of the lower blade 30 is imparted with equal or substantially equal magnitude axial components of the fluid flow. As shown in the top view of FIG. 15, the complex motion of the fluid within the container 24 can include a similar pattern distributed radially throughout the container 24 as represented by arrows 146. In one example, the mixing device 20 can develop a substantially uniform velocity of the fluid throughout the container 24.

The length of the axial flow path as described above can be determined for any type of mixing device by any suitable method. In one example, the mixing device can be placed in a test rig such as the example described below and noting the path of particulate matter within the fluid being mixed. In another example, testing samples can be taken from a number of elevations within the container to determine the amount of particulate matter dispersion throughout the container at the number of elevations.

In one example, the mixing device 20 can be used to mix paint prior to a desired paint application process. In this example, after assembly and powder coat operations, the mixing device 20 can be inserted into a container 24. For paint application processes that consume relatively large quantities of paint, the container 24 can be a 55-gallon drum. The cage 140 of the mixing device 20 slides over a structure attached to the interior floor 70 of the 55-gallon drum. The structure can be a pin-like structure 142 that helps locate the mixing device 20 within the 55-gallon drum, provides a ready rotation point for the mixing device 20, and also helps prevent lateral motion of the mixing device within the 55-gallon drum.

In some instances, the mixing device 20 is inserted into the drum by the drum manufacturer. In the event that the 55-gallon drum is sent to another location in order to be filled with a fluid (e.g., paint), a lid 150 is then placed over the open end of the 55-gallon drum. The lid 150 can define a hole 164 (best seen in FIG. 1) or a bung, which is substantially collinear with the pin-like structure 142 on the floor 70 of the 55-gallon drum. Both of these features can be located on or substantially on the central axis of the 55-gallon drum. The lid 150 can include a ring 154 or other surface configured to interact with the keeper 138 on the mixing device 20. In one example, the ring 154 can be attached to the lid 150 via at least one arm 158 so that the ring 154 is placed within the internal volume of the 55-gallon drum when the lid 150 is in its closed position. The proximal end 136 of the mixing device 20 (e.g., the proximal end of the shaft) can extend through the ring 154. The ring 154 and the keeper 138 attached to the shaft 26 can provide a physical interference preventing the mixing device 20 from traveling greater than a desired distance toward the opening of the 55-gallon drum. Thus, the mixing device 20 is held in place during movement, storage, shipment, etc. by the pin-like structure 142 and the ring 154 attached to the lid 150. In one example, the lid 150 can serve as a splash guard to prevent the fluid within the container from escaping during a mixing operation.

As noted above, the 55-gallon drum can be sent to another location in order to be filled with a fluid (e.g., paint). A paint manufacturer and a paint distributor are both examples of a location where the 55-gallon drum can be filled with paint. The lid 150 is then removed, and a quantity of paint is placed within the interior space of the 55-gallon drum. The lid 150 is then re-attached and secured by any means as are known in the art. In another example, the lid 150 remains attached to the 55-gallon drum during the filling process, and the filling operation is completed through any available hole or bung in the lid 150 or in any other portion of the 55-gallon drum.

In some cases, the paint manufacturer sends the 55-gallon drum containing the paint and the mixing device 20 to an end user. Frequently, paints include a quantity of particulate matter that in the form of pigment. In one example, these pigments are evenly suspended throughout a liquid component of the paint, forming a colloid. However, the pigments often settle to the lowest point of any container thereby leaving the colloid so that the paint is then made up of a liquid component and a quantity of particulate matter pigment that has settled to the bottom of a container 24. In order to have even paint color distribution during the paint application process, it is often desirable to mix the paint prior to paint application.

The end user can then remove a cap from a hole 164 in the lid 150 of the 55-gallon drum to gain access to the proximal end 136 of the mixing device 20. As previously described, the proximal end 136 of the mixing device 20 includes a hub 134. The end user can then place an air motor (e.g., an air drill) in communication with the hub 134, activate the air motor, and rotate the mixing device 20 in order to mix the paint within the 55-gallon drum. In one example, a portion of the air motor and/or a fitting attached to the air motor extends through the hole 164 and at least partially into the internal volume of the 55-gallon drum. As such, the lid 150 of the 55-gallon drum does not need to include a seal between the mixing device 20 and the lid 150 or other external wall of the 55-gallon drum, as the mixing device 20 can be located entirely within the internal volume of the 55-gallon drum. The described mixing device 20 is configured to move the particulate matter pigment away from the bottom of the 55-gallon drum, place the particulate matter pigment back into a colloid condition, and evenly distribute the pigment throughout the 55-gallon drum. The mixing device 20 is configured to create a complex flow of paint within the container by combining axial fluid flow and radial fluid flow. In one example, the equality of distribution of the pigment can be measured by sampling the amount of particulate matter taken from the container in a collection cup from an area above the upper blade 28 and below the upper blade 28 and comparing the amount of particulate in the two samples. In a more particular example, the amount by weight of the particulate matter found in the collection cups from two different areas are equal or are substantially equal.

At least one example test rig was constructed to test the mixing device 20. Two windows were cut into a standard 55-gallon drum diametrically opposed to one another. A clear material was placed into each window area and sealed to the wall of the 55-gallon drum using gasket material and a metal frame for the clear material. In one example, the clear material can be Plexiglas, and can be selected to replicate the strength of the 55-gallon drum wall. The metal frame for each window were fastened to the 55-gallon drum with threaded fasteners, however, any suitable fastening components can be used.

The described mixing device 20 was inserted into the 55-gallon drum, and the drum was filled with a fluid. In one example, the fluid chosen was soybean oil in order to closely match the viscosity of a typical paint to be mixed by such the mixing device 20. 1,300 grams of sand were added to the soybean oil and permitted to settle to the bottom of the 55-gallon drum. The sand replicates the particulate matter of the pigment within a typical paint. An air motor was engaged with the hub of the mixing device 20 and activated to rotate the mixing device 20. The mixing device 20 was run to a steady-state condition and three-seconds were allotted for insertion of a collection cup into the 55-gallon drum while the mixing device was rotating. A first collection cup was inserted into the area above the upper blade 28 during operation yielding 3.9 grams of sand in the first collection cup. Similarly, a second collection cup was inserted into the area below the upper blade 28 during operation yielding 3.9 grams of sand in the second collection cup. No appreciable sand collection was observed at the bottom of the 55-gallon drum during operation.

An example method of mixing a fluid within a container will now be described. The method can be performed in connection with the example mixing device and container shown in FIG. 1. The method includes the step of providing a container. As previously described, the container can be similar to a 55-gallon drum. In one particular example, the container is a standard 55-gallon drum.

The method includes the step of locating a mixing device within the container. The mixing apparatus comprises a shaft, a plurality of blades attached to the shaft, wherein the blades include a variable pitch angle. The variable pitch angle is configured to create axial fluid flow and radial fluid flow within the container. The mixing apparatus also includes a hub located at a proximal end of the apparatus and a cage located at a distal end of the apparatus. The cage comprises an open end configured to mate with a structure attached to the container.

The method also includes the step of inserting a quantity of the fluid within the container. As previously described the fluid can be paint. It is to be appreciated that the fluid can be paint, chemicals, or any other fluid, colloid, or solid particles that flow like a fluid, etc. that may benefit from being mixed into a homogeneous condition to have a continuous chemistry (e.g., a consistent chemistry throughout the fluid) and/or a temperature that is consistent or is substantially consistent throughout the fluid. The paint can include a liquid component and an amount of solid particle pigments. In one example, the solid particle pigments can be in a size range of about 0.055 inch to about 0.035 inch.

The method further includes the step of rotating the mixing apparatus. In one example, the mixing apparatus can be rotated within the fluid by engaging the hub with an air motor (e.g., an air drill) and operating the air motor. The rotation of the mixing apparatus creates an axial flow vector and a radial flow vector that combine to create a complex flow.

The method still further includes the step of mixing the fluid. In one example, mixing the fluid includes creating a homogeneous mixture of any liquid components of the fluid and particulate matter within the fluid. The homogeneous mixing of the fluid can be measured by the equality of particulate matter found in various areas of the container during or immediately after mixing. For the purposes of this disclosure, the mixing operation is not mere stirring, or agitation of the fluid, but the creation of an even or substantially even distribution of particulate matter throughout several areas of the container. The particulate matter then remains in a colloidal suspension for an amount of time after the mixing device ceases rotation.

The step of mixing can include pumping of the fluid from one or several areas of the container volume to another or several other areas of the container volume. The step of mixing can include a complex flow of the fluid within the container. In one example, an equilibrium flow of fluid (e.g., paint) can be created in about thirty seconds of the mixing device operation.

It is to be appreciated that some embodiments of the described apparatus and methods for using the apparatus can include particular attributes which are not limited to the following:

A mixing device requiring less energy to operate while still effectively mixing fluid within a container. For the purposes of this disclosure, the effective mixing of the fluid is considered to be more than merely agitating or stirring the fluid. It is to be understood that the mixing device requiring less energy includes a device that will require less torque to spin at the same revolutions per minute (RPM) compared to some known stirring devices. By the same principal, the described mixing device can operate at greater RPM with the same torque input compared to some known devices. In one example, the described mixing device can attain about 150% of the RPM of a known mixing device with the same torque input.

It is also to be appreciated that some embodiments of the described mixing device can consume significantly less power during operation while achieving the same or better results than known mixing devices. Furthermore, some embodiments of the mixing device can achieve a steady state of complex flow of the fluid within the container in about thirty seconds. As such, the mixing device requires less power while operating and requires less time to operate to create a substantially homogeneous mixture of the fluid within the container. In one example, the substantially homogeneous distribution of particulate matter can be a paint pigment distributed throughout the fluid which can be paint.

Some embodiments of the described mixing device can create a combination of axial fluid flow and radial fluid flow rather than only one of these fluid flows to mix a fluid. The construction of the upper blade and the lower blade can develop pumping and/or blending to truly mix the fluid, not merely create eddy currents or agitation of the fluid. The mixing device can become a pump that creates a fluid flow throughout the container rather than a series of eddy currents. The mixing can develop a substantially homogeneous temperature throughout the fluid. Additionally, the mixing can create a distribution of particulate matter in a lower portion of the container that is substantially equal to a distribution of particulate matter in an upper portion of the container. Finally, some embodiments of the described mixing device can be significantly less expensive to construct in comparison to other mixing devices.

The apparatus and methods have been described with reference to the example embodiments described above. Modifications and alterations will occur to others upon a reading and understanding of this specification. Example embodiments incorporating one or more aspects of the apparatus and methods are intended to include all such modifications and alterations.

What is claimed is:

1. An apparatus for mixing a fluid within a container comprising:

a container;

a shaft;

a blade attached to the shaft, wherein the blade includes a variable pitch angle, the variable pitch angle is configured to create axial fluid flow, and radial fluid flow within the container, wherein the variable pitch angle is about 60 degrees proximate to the shaft, the variable pitch angle is about 40 degrees at a location between the shaft and an end of the blade, and the variable pitch angle is about 20 degrees near the end of the blade, such that the change in pitch angle from proximate the shaft to near the end of the blade is about 40 degrees; a hub located at a proximal end of the shaft; and a first rib having a convex shape in relationship with a leading side of the blade and a second rib having a concave shape in relationship to the leading side of the blade; and wherein said shaft, blade, and hub are located entirely within the container.

2. The apparatus of claim 1, wherein the variable pitch angle is configured to create axial flow in a substantially upward direction such that the length of an axial flow path is between about 0.8 and about 1.2 times the length of an inside dimension of the container.

3. The apparatus according to claim 1, further comprising a cage located at a distal end of the apparatus, wherein the cage includes an open end configured to mate with a structure attached to a floor of the container.

4. The apparatus according to claim 1, wherein a portion of the blade is located a distance above a floor of the container, wherein the distance is between about 1-inch and about 3-inches.

5. The apparatus according to claim 1, wherein the apparatus further comprises a secondary pumping blade, the secondary pumping blade is configured to help prevent a stagnant volume of fluid at the center of the container near the floor of the container.

6. The apparatus according to claim 1, wherein a length of the blade is between about 40% and about 70% of an inside diameter of the container.

7. The apparatus according to claim 6, wherein a width of the blade is between about 20% and about 30% of the length of the blade.

8. The apparatus according to claim 1, wherein the blade further includes a ridge to form a hydrofoil.

9. The apparatus according to claim 8, wherein the ridge is located on a leading side of the blade.

10. The apparatus according to claim 1, wherein the variable pitch angle is configured to optimize an axial component of fluid flow such that the fluid flow leaving the blade along substantially the entire length of the blade is imparted with the axial components having an equal or substantially equal magnitude.

11. The apparatus according to claim 1, wherein the blade is attached to the shaft such that the ultimate tensile strength of the attachment is at least substantially equal to the ultimate tensile strength of the shaft.

12. The apparatus according to claim 1, wherein the axial fluid flow has an axial vector component and the radial fluid flow has a radial vector component, the axial vector component and the radial vector component combine to create a complex fluid flow in three dimensions.

13. The apparatus according to claim 1, further comprising an upper blade attached to the shaft, wherein the upper blade and the blade are attached to the shaft at two different elevations on the shaft.

14. The apparatus according to claim 13, wherein a length of the upper blade is about 40% of an inside dimension of the container.

15. A method of mixing a fluid within a container comprising:

providing a container;

locating a mixing apparatus within the container, the mixing apparatus comprising a shaft;

a blade attached to the shaft, wherein the blade includes a variable pitch angle, the variable pitch angle is configured to create axial fluid flow, and radial fluid flow within the container, wherein the variable pitch angle is about 60 degrees proximate to the shaft, the variable pitch angle is about 40 degrees at a location between the shaft and an end of the blade, and the variable pitch angle is about 20 degrees near the end of the blade, such that the change in pitch angle from proximate the shaft to near the end of the blade is about 40 degrees; a hub located at a proximal end of the shaft; and a first rib having a convex shape in relationship with a leading side of the blade and a second rib having a concave shape in relationship to the leading side of the blade;

rotating the mixing apparatus within the container, wherein rotating the mixing apparatus creates an axial flow vector and a radial flow vector combining to create a complex flow; and mixing a quantity of the fluid within the container.

16. The method according to claim 15, wherein the step of mixing a quantity of the fluid further comprises developing a steady state flow within the container.

17. The method according to claim 15, wherein the step of mixing a quantity of the fluid further comprises developing a fluid flow creating a substantially homogeneous temperature throughout the fluid.

18. The method according to claim 15, wherein the step of mixing a quantity of the fluid further comprises developing a fluid flow creating a substantially homogeneous distribution of particulate matter throughout the fluid.

19. An apparatus for mixing a fluid within a container comprising:

a shaft;

a blade attached to the shaft, wherein the blade includes a variable pitch angle, the variable pitch angle to create axial fluid flow, radial fluid flow within the associated container, the change in variable pitch angle being about 40 degrees from proximate the shaft to near an end of the blade, the variable pitch angle is about 60 degrees proximate to the shaft, the variable pitch angle is about 40 degrees at a location between the shaft and an end of the blade, and the variable pitch angle is about 20 degrees near the end of the blade, the blade comprising a first rib having a convex shape in relationship with a leading side of the blade and a second rib having a concave shape in relationship to the leading side of the blade.

20. The apparatus of claim 19, further comprising:

an upper blade disposed on the shaft and coaxial with the blade, the blade being disposed below the upper blade, the upper blade having a variable pitch angle to create axial fluid flow and radial fluid flow within the container.

21. The apparatus of claim 19, wherein the blade is a pumping blade, the apparatus further comprising a secondary pumping blade disposed below the blade, the secondary pumping blade to help prevent a stagnant volume of fluid at the center of the associated container near a floor of the associated container.

22. The apparatus of claim 19, the variable pitch angle is defined between a surface of a leading side of the blade and a horizontal line substantially perpendicular to the shaft.

23. The apparatus of claim 19, wherein the axial fluid flow comprises substantially constant axial velocity vectors.

24. The apparatus of claim 19, comprising a hub located at a proximal end of the shaft, wherein said shaft, blade, and hub can be accessed for use prior to a mixing operation.

25. The apparatus of claim 19, wherein the blade comprises a cage, the cage being directly attached to the shaft.

* * * * *